US008312591B1

(12) United States Patent
Wolfe, Jr. et al.

(10) Patent No.: US 8,312,591 B1
(45) Date of Patent: Nov. 20, 2012

(54) WALL-MOUNTABLE VACUUM CLEANER AND BRACKET COMBINATION

(75) Inventors: Melvin E. Wolfe, Jr., Kirkwood, NY (US); Kevin D. Fry, South Williamsport, PA (US); Jason Gottschall, South Williamsport, PA (US); John Griffin, Phoenix, AZ (US)

(73) Assignee: Shop Vac Corporation, Williamsport, PA (US)

( * ) Notice: Subject to any disclaimer, the term of this patent is extended or adjusted under 35 U.S.C. 154(b) by 19 days.

(21) Appl. No.: 13/182,986

(22) Filed: Jul. 14, 2011

(51) Int. Cl.
*A47L 9/00* (2006.01)

(52) U.S. Cl. ..... 15/323; 15/327.5; 15/344; 15/410

(58) Field of Classification Search ..... 15/323, 15/327.5, 344, 410; 211/65, 87.01
See application file for complete search history.

(56) References Cited

U.S. PATENT DOCUMENTS

| | | | | |
|---|---|---|---|---|
| 1,884,865 | A | 10/1932 | Replogle | |
| 4,541,142 | A * | 9/1985 | Pudwill | 15/323 |
| 4,763,382 | A * | 8/1988 | Sumerau | 15/323 |
| 5,513,416 | A * | 5/1996 | Bassler et al. | 15/323 |
| 6,189,178 | B1 * | 2/2001 | Roberts | 15/323 |
| 6,557,206 | B1 | 5/2003 | Liu | |
| 7,421,760 | B2 * | 9/2008 | Zimmerle et al. | 15/323 |
| 7,555,809 | B2 | 7/2009 | Liu | |
| 2008/0276411 | A1 * | 11/2008 | Liu | 15/323 |
| 2011/0107547 | A1 | 5/2011 | Liu | |

FOREIGN PATENT DOCUMENTS

| | | |
|---|---|---|
| CH | 185124 A | 7/1936 |
| GB | 466473 A | 5/1937 |

OTHER PUBLICATIONS

U.S. Appl. No. 13/177,938, Portable Combined Toolbox and Vacuum Cleaner, Wolfe et al., filed Jul. 7, 2011.
International Search Report and Written Opinion for corresponding International Application No. PCT/US2011/049626, dated Mar. 22, 2012.

* cited by examiner

*Primary Examiner* — David Redding
(74) *Attorney, Agent, or Firm* — Marshall, Gerstein & Borun LLP; Richard M. LaBarge; Robert M. Gerstein

(57) ABSTRACT

A new wall-mountable vacuum cleaner and bracket combination provides easy locking. Both the vacuum cleaner and the bracket have mounting rims. When the vacuum cleaner is on the bracket, a support surface on a proximal end of one of the two mounting rims engages a terminal edge of the other of the two mounting rims. The vacuum cleaner can be secured in place by moving a movable arm from an extended position to a retracted position in which the vacuum cleaner is locked in place. To accommodate the required movement of the movable arm, the bracket has a deflectable locking edge that moves between a rest position and a deflected position. In the rest position, the distance between the locking edge and the terminal edge of the bracket mounting rim exceeds the distance between the terminal edge of the vacuum mounting rim and the base surface, but is less than the distance from the terminal edge of the vacuum mounting rim to the part of the vacuum cleaner that lies directly beneath the locking edge when the vacuum cleaner is stored on the bracket.

6 Claims, 9 Drawing Sheets

SECTION B-B

WALL-MOUNTABLE VACUUM CLEANER AND BRACKET COMBINATION

CROSS-REFERENCE TO RELATED APPLICATIONS

Not applicable.

BACKGROUND OF THE INVENTION

The present invention relates generally to vacuum cleaners and more particularly to wall mountable vacuum cleaners.

BRIEF SUMMARY

The applicants have developed wall-mountable vacuum cleaner and bracket combination that provides easy locking. Like prior known wall-mounted vacuum cleaner products, the new combination has a vacuum cleaner that a user can store on a wall-mountable bracket. When the bracket is mounted to a wall, a mounting rim on the vacuum cleaner fits between the wall and a mounting rim on the bracket. A support surface is connected to a proximal end of one of the two mounting rims and engages a terminal edge of the other of the two mounting rims when the vacuum cleaner is positioned on the bracket.

Like some other vacuum cleaners, the new vacuum cleaner has a movable arm in the form of a handle that a user can move between a retracted position and an extended position. In the retracted position, one side of the movable arm lies against a base surface within a recess in the upper surface of the vacuum cleaner and an opposed side is spaced away from the base surface. In the extended position, the movable arm is spaced from the base surface and a handgrip is accessible above an upper surface of the vacuum cleaner.

Unlike prior known combinations, the vacuum cleaner in the new arrangement can be secured to the bracket by moving the movable arm from the extended position to the retracted position. This functionality is enabled by a deflectable locking edge on the bracket.

The locking edge moves between a rest position and a deflected position. In the rest position, the distance between the locking edge and the terminal edge of the bracket mounting rim exceeds the distance between the terminal edge of the vacuum mounting rim and the base surface. This minimum spacing enables the vacuum cleaner to be positioned on the bracket without interference from the locking edge when the movable arm is extended.

In the rest position, the distance between the locking edge and the terminal edge of the bracket mounting rim is less than the distance from the terminal edge of the vacuum mounting rim to the part of the vacuum cleaner that lies directly beneath the locking edge when the vacuum cleaner is stored on the bracket. This maximum spacing between the locking edge and the terminal edge of the bracket mounting rim enables the mounting rims to block removal of the vacuum cleaner from the bracket when the movable arm is in the retracted position.

In the deflected position, the movable arm can be moved between the extended position and the retracted position while the vacuum cleaner is positioned on the bracket, and the vacuum cleaner can then be removed from the bracket.

BRIEF DESCRIPTION OF THE DRAWINGS

The invention may be better understood by referring to the accompanying drawings, in which.

DETAILED DESCRIPTION

Figure 1:
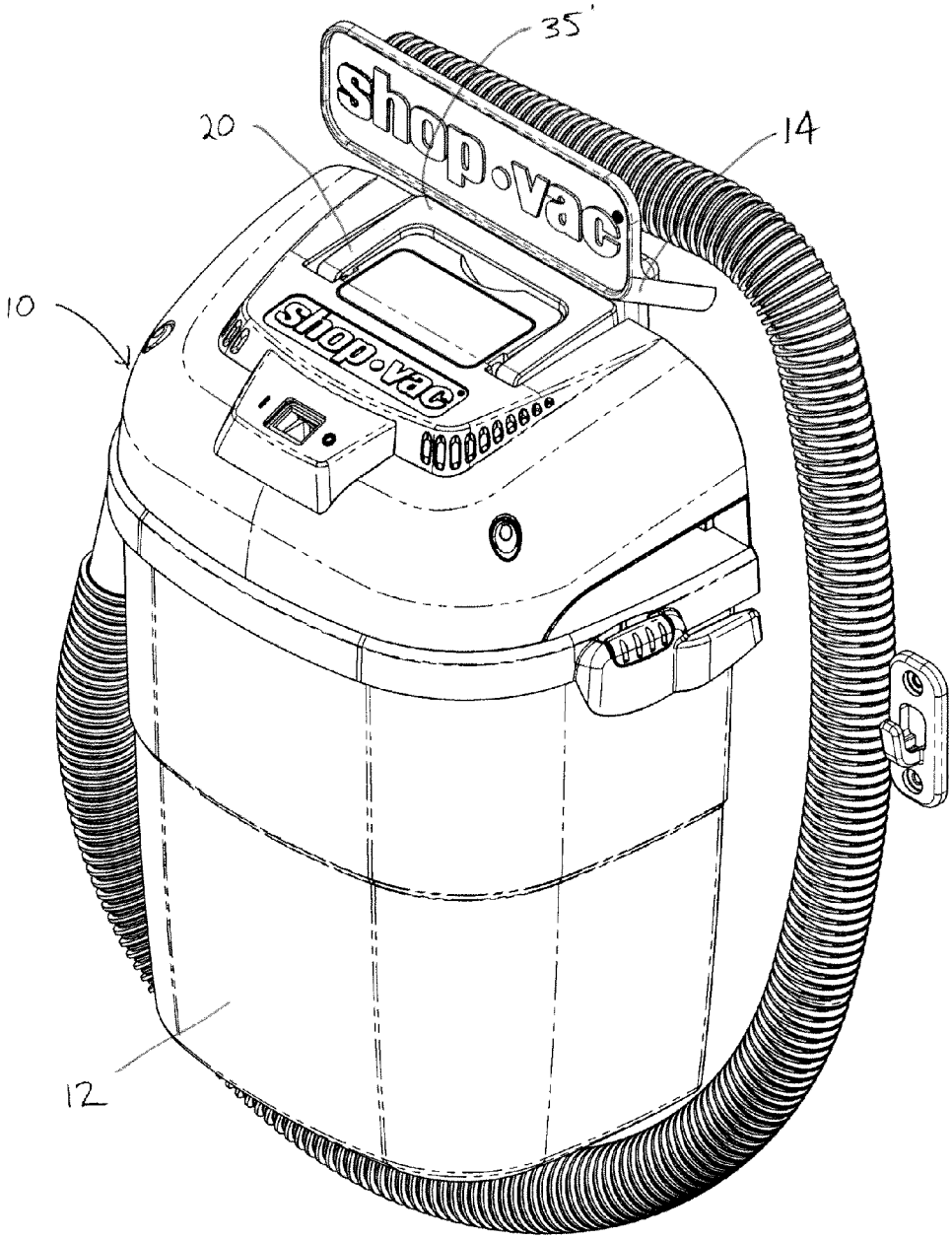
FIG. 1 is a perspective view of a combination vacuum cleaner and bracket that uses the invention.

One example of a wall-mountable vacuum cleaner and bracket combination that uses the new invention is illustrated in the accompanying drawings. As seen in FIG. 1, that combination 10 includes a vacuum cleaner 12 and a bracket 14. These components will be discussed below, followed by a description of how they work together.

The Vacuum Cleaner

The vacuum cleaner 12 is used for vacuuming, and may have well-known conventional structure for powering a vacuum source, generating a vacuum, channeling the force of the vacuum, directing vacuumed material, and storing that material. New or unconventional structure can also be used for performing these functions without departing from the intended scope of the invention. For the purposes of this invention, what is important is that the vacuum cleaner have a particular form of a movable arm 20 and a suitable vacuum mounting rim 44. A bracket support surface 65 should also be included on either the vacuum cleaner or on the bracket 14. The illustrated vacuum cleaner has a support surface on the vacuum cleaner. Each of these three components will be discussed in turn.

The Movable Arm

The movable arm 20 is used to lock the vacuum cleaner 12 onto the bracket 14. As illustrated, it may also serve as a handle for carrying the vacuum cleaner, but this is not always required.

Figure 2:
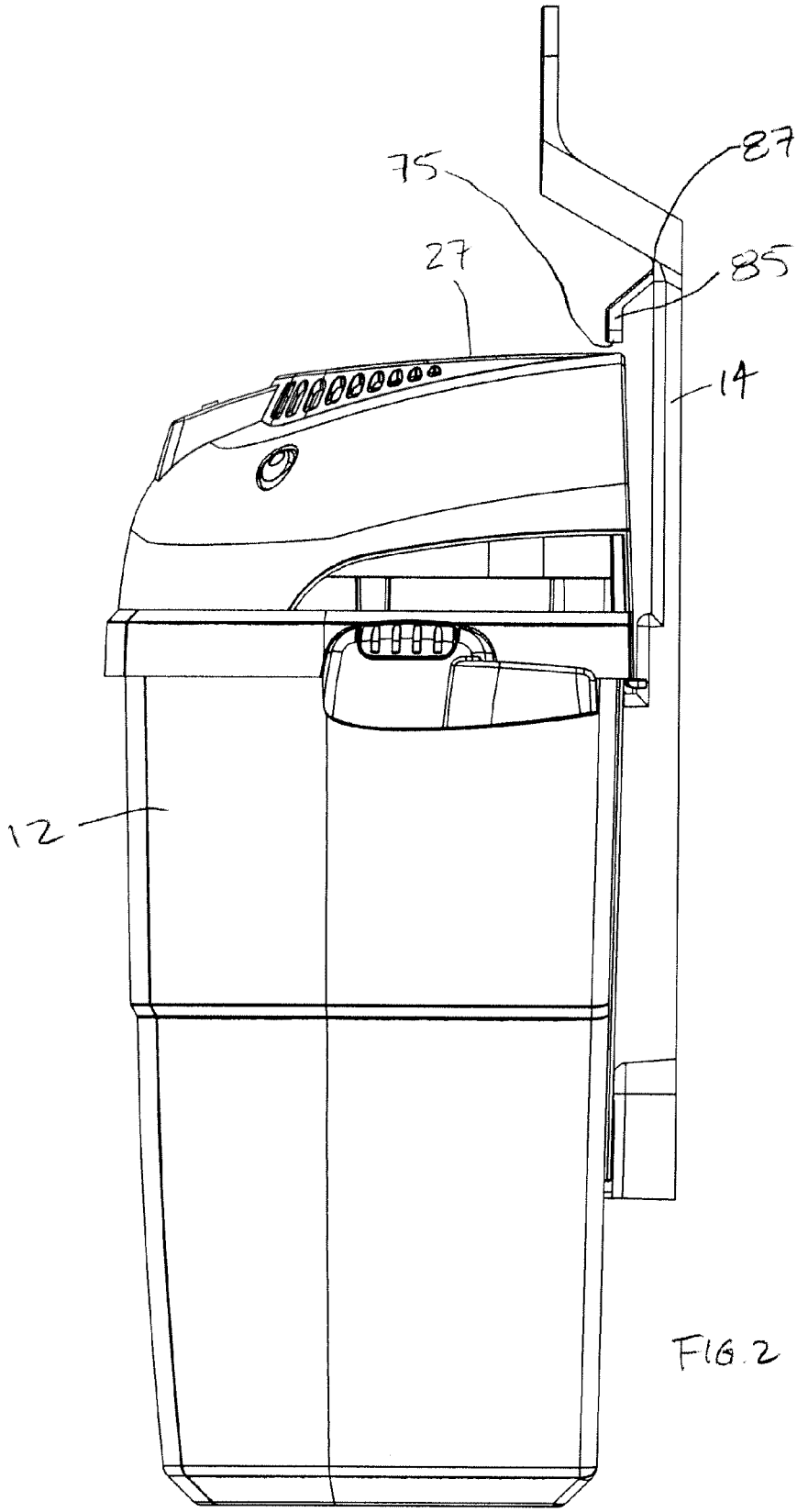
FIGS. 2-4 are side views of the combination, in different positions.
Figure 3:
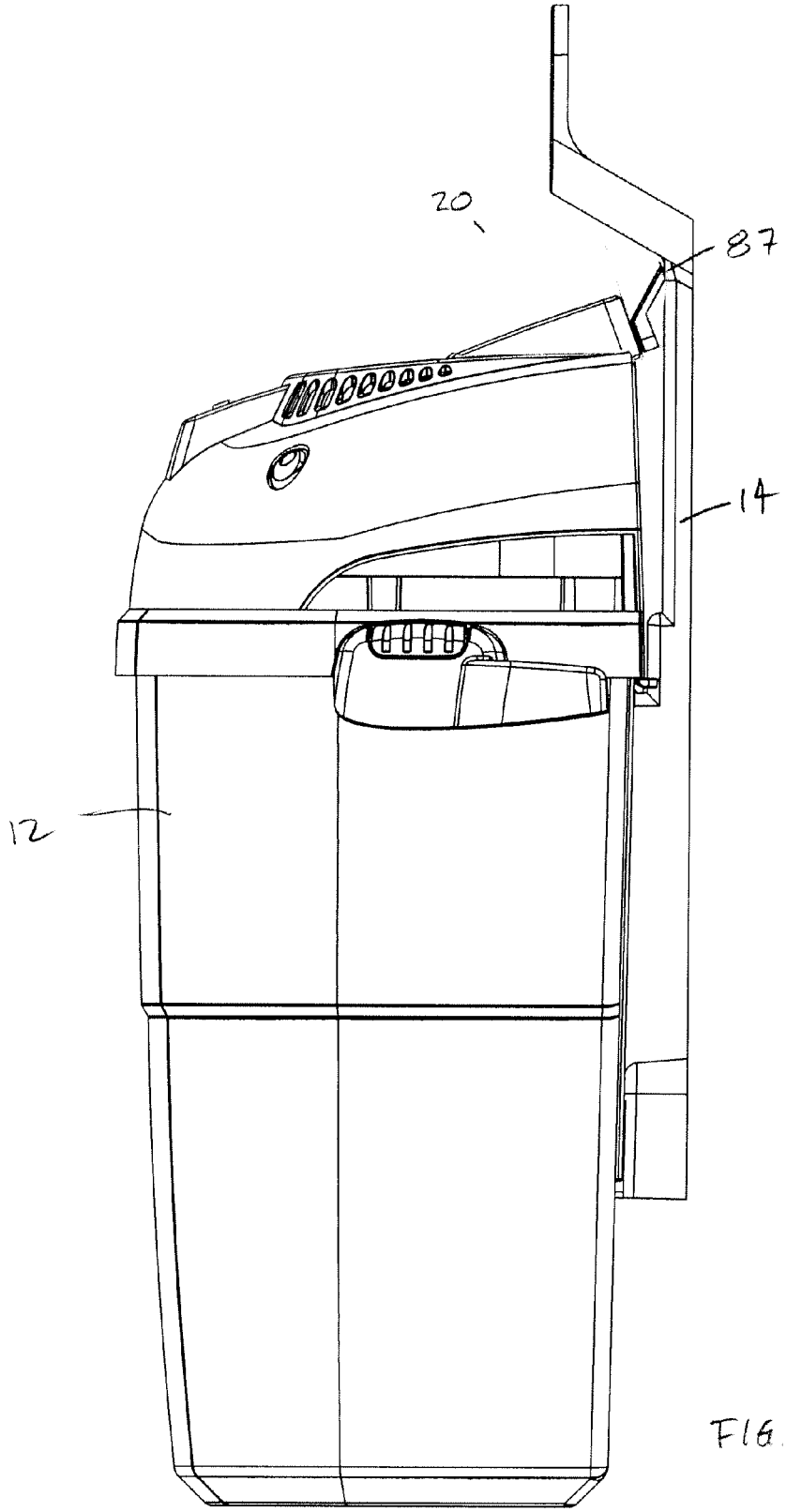
Figure 4:
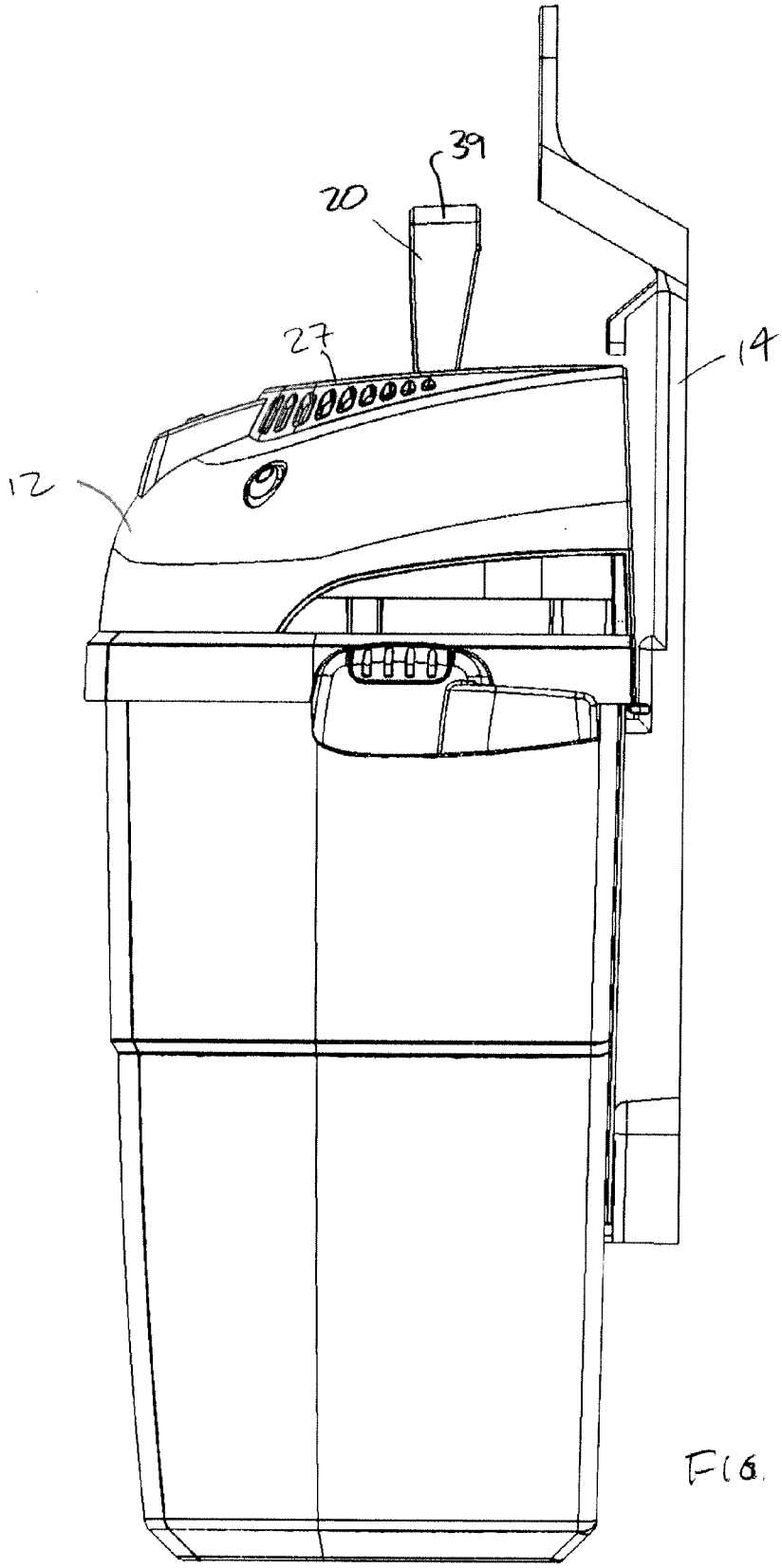

The movable arm 20 moves from a retracted position, such as the one seen in FIG. 2, to an intermediate position, such as the one seen in FIG. 3, to an extended position, such as the one seen in FIG. 4. In the retracted position, the movable arm fits in a recess 25 on the vacuum cleaner. In the extended position, it is moved outside that recess.

Figure 5:
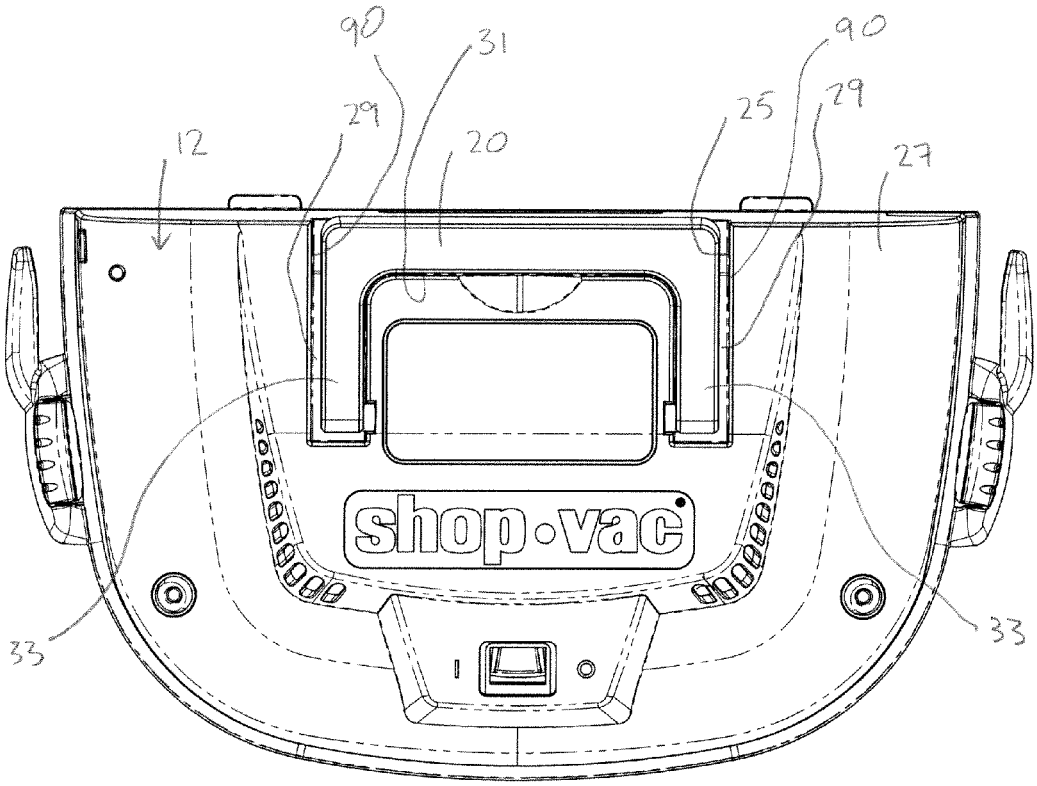
FIGS. 5 and 6 are top and back views of the vacuum cleaner.
Figure 6:
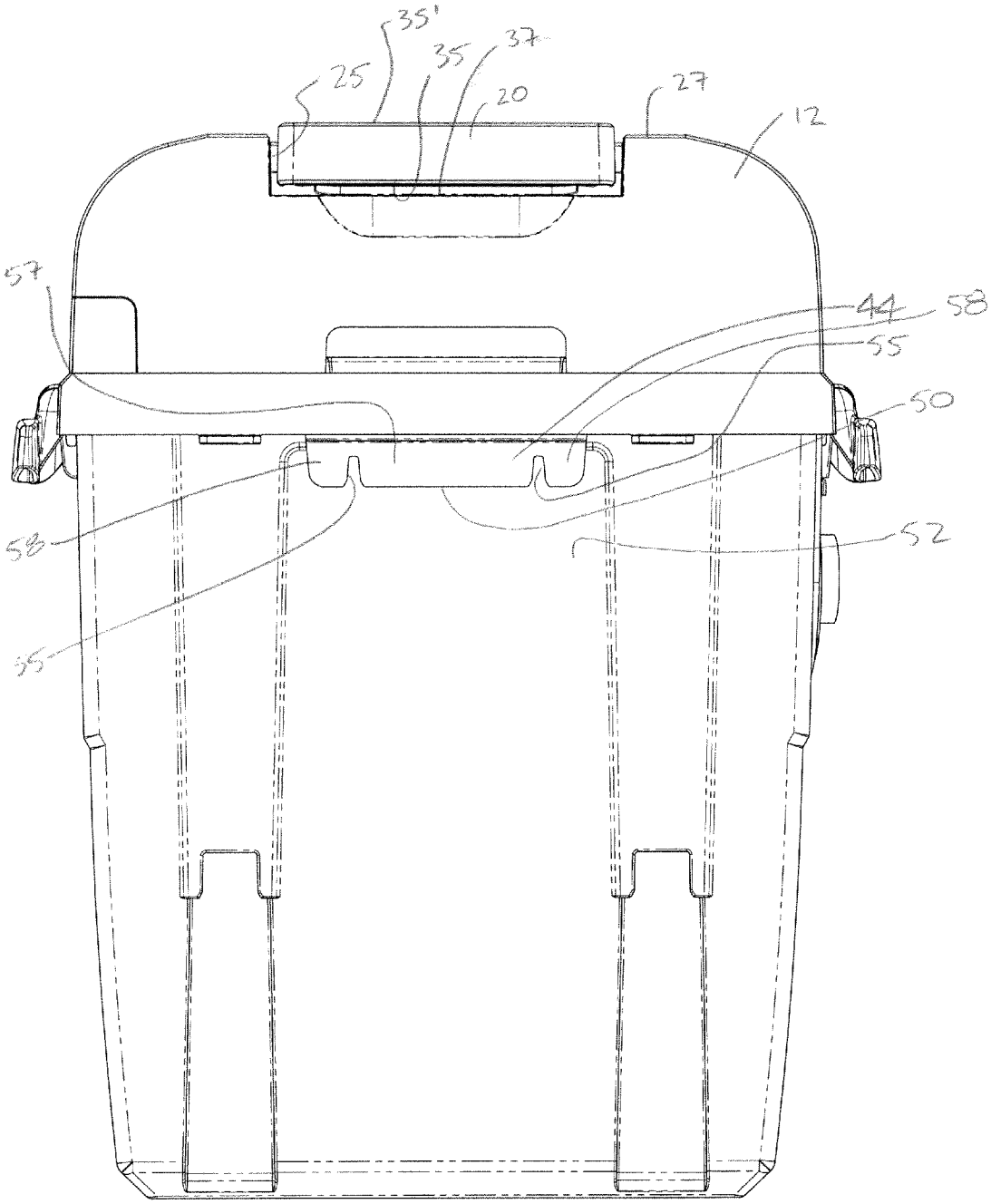

The illustrated recess 25 is in a relatively planar top surface 27 of the vacuum cleaner 12. In other embodiments, the recess might be in a vertical surface or a slanted surface on the vacuum cleaner. As seen in FIGS. 5 and 6, the illustrated recess is open to what can be viewed as the back side of the vacuum cleaner. As seen in FIG. 5, the illustrated vacuum cleaner has two slots 29 that communicate with and extend from opposite ends of an inner vertical side 31 of the recess.

The movable arm 20 in the illustrated product is a u-shaped handle that has ends 33 that are hinged in the two slots 29. As seen in FIG. 6, when the movable arm is in the retracted position, one side 35 of the arm lies adjacent a base surface 37 within the recess 25 and an opposed side 35' is spaced away from the base surface. In the extended position (FIG. 4), the movable arm is rotated out of the recess, with only the hinged ends of the arms remaining in the slots and space being provided between the top surface 27 of the vacuum cleaner 12 and the distal side 39 of the movable arm. In that position, the distal side of the illustrated movable arm serves as a convenient handle for holding, carrying, or lifting the vacuum cleaner. Many other sizes and configurations of movable arms can be used, but the size and configuration may affect the size and arrangement of the bracket 14, as will be evident from the description of the bracket that will be provided in a later section.

The Vacuum Mounting Rim

Figure 7:
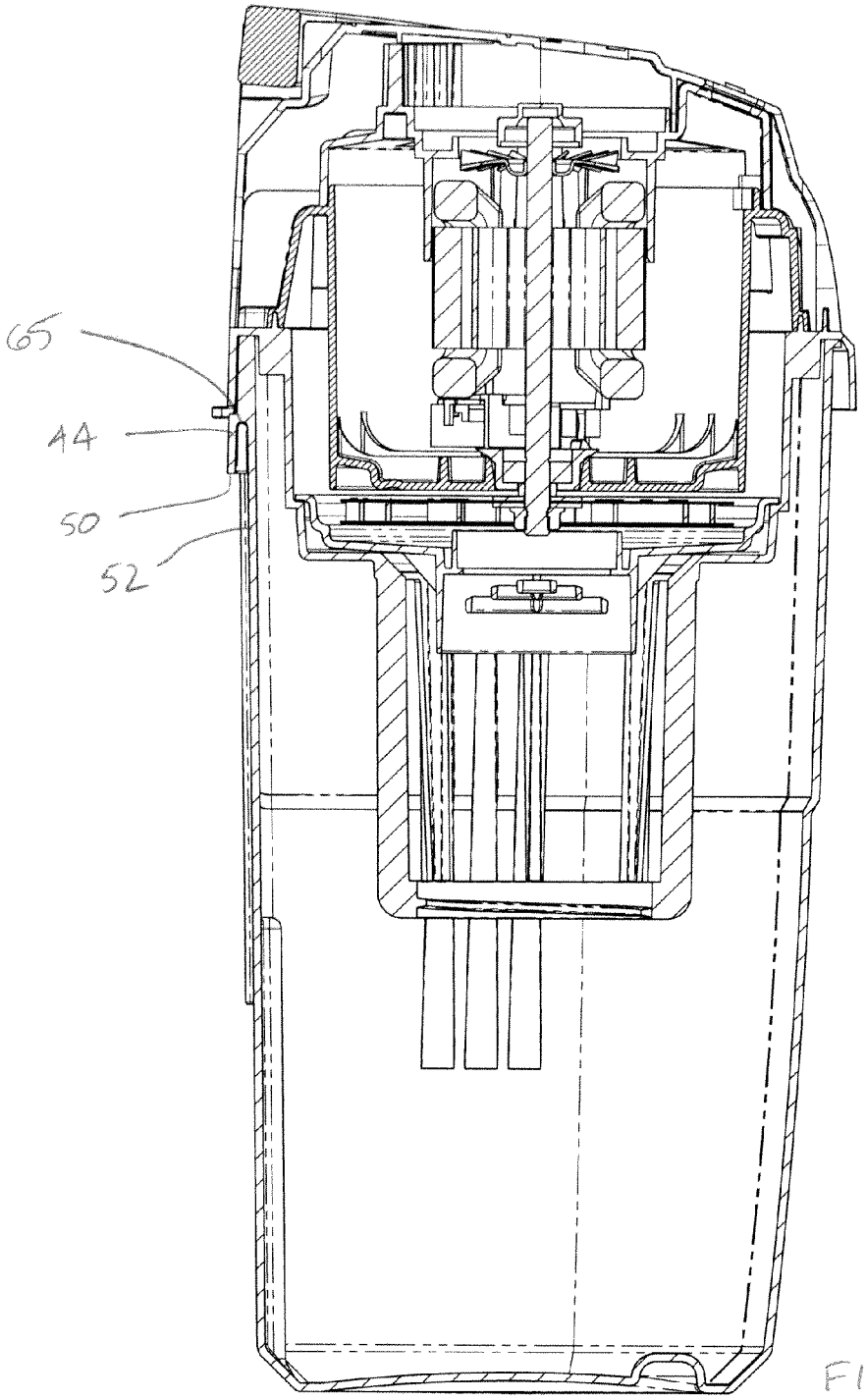
FIG. 7 is a cross-sectional side view of the vacuum cleaner.

As seen in FIGS. 6 and 7, the vacuum mounting rim 44 is spaced from the base surface 37 and is used for mounting the vacuum cleaner on the bracket 14. Many details of this mounting rim can be varied. However, as discussed in more detail in a later section, the vacuum mounting rim must work with the bracket mounting rim, and changes in one mounting rim may require corresponding changes in the other mounting rim.

Figure 8:
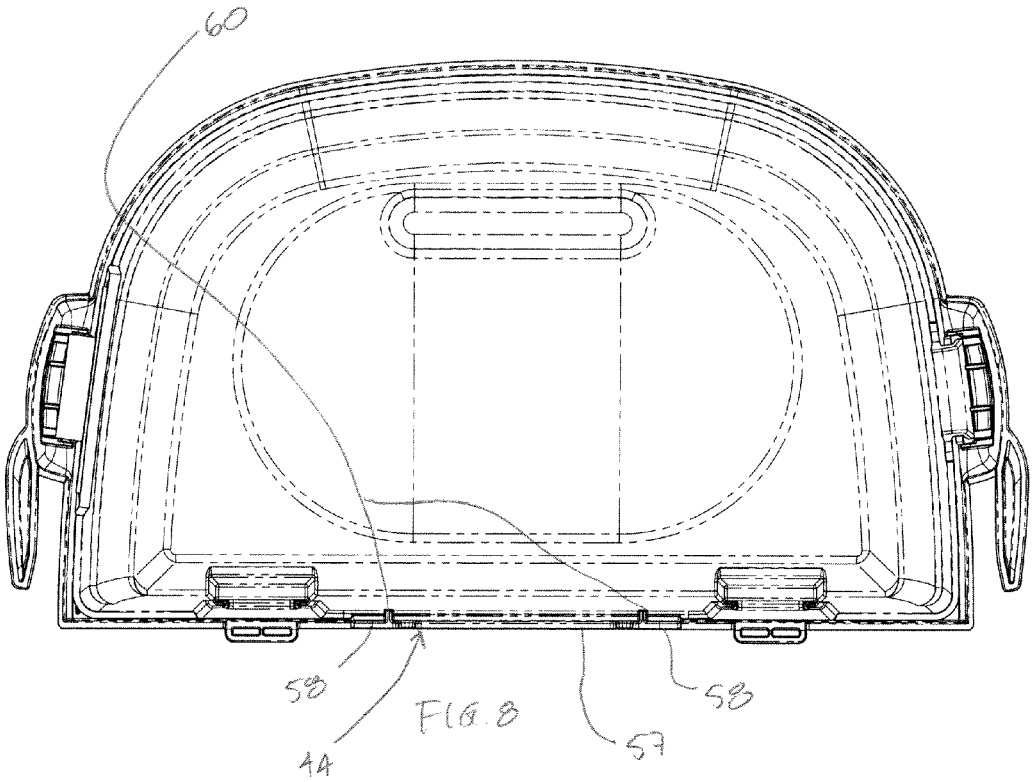
FIG. 8 is a bottom view of the vacuum cleaner.

The vacuum mounting rim 44 in the illustrated vacuum cleaner 12 is vertically-disposed, and made of plastic, spans approximately ⅓ the width of the vacuum cleaner, and has a height of between ¼ inch and 3 inches. As best seen in FIG. 7, it has a terminal edge 50 that is spaced between ¼ inch and two inches from a side wall 52 of the vacuum cleaner. As best seen in FIG. 6, the illustrated vacuum mounting rim has two grooves 55 that separate a central section 57 of the mounting rim from outer end sections 58 of the mounting rim. As best seen in FIG. 8, the illustrated rim is strengthened by short vertical ribs 60 that extend inwardly from the outer end sections. Again, the vacuum mounting rim can have many other sizes and configurations, but the size and configuration may affect the size and configuration of the corresponding bracket mounting rim or of other parts of the bracket 14.

The Support Surface on the Vacuum Cleaner

The support surface 65 (FIG. 7) serves to transfer some of the weight of the vacuum cleaner 12 to the bracket 14. Although there may be other ways to accomplish the desired result, the illustrated vacuum cleaner 12 has a support surface 65 at the base of the vacuum mounting rim 44. This support surface is integrally molded with and extends between the vacuum mounting rim and the side wall 52. How it functions will be explained in more detail in a later section. Once again, the support surface can have many other sizes and configurations, provided that the other components of the combination 10 are sized and configured accordingly.

The Bracket

The bracket 14 provides a wall mount for storing the vacuum cleaner 12, and may have well-known conventional structure for mounting a base 70 of the bracket to a wall. New or unconventional structure can also be used for performing this function without departing from the intended scope of the invention. For the purposes of the invention, what is important is that the bracket also have a suitable bracket mounting rim 72 and a suitable deflectable locking edge 75. The base, the bracket mounting rim, and the deflectable locking edge will each be discussed in turn.

The Base

Figure 9:
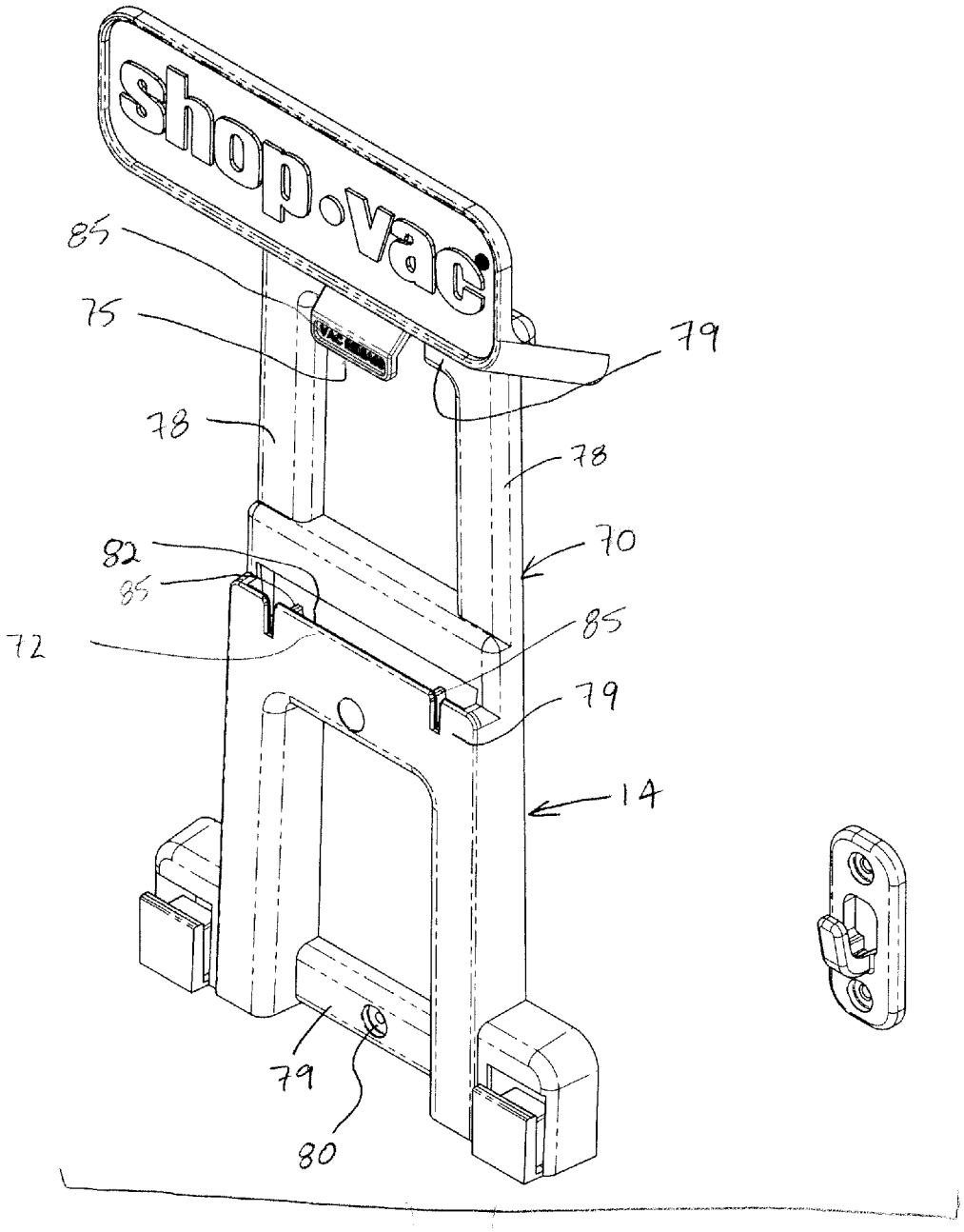
FIG. 9 is a perspective view of the bracket.

The base 70 of the bracket 14 seen in FIG. 9 is made of molded plastic and has two lateral stiles 78 joined by three cross rails 79. One or more mounting holes 80 in the rails enable a user to connect the base to a wall with nails or screws. Many other arrangements can also be used, including, for example, a base that is generally planar.

The Bracket Mounting Rim

The bracket mounting rim 72 works with the vacuum mounting rim 44 on the vacuum cleaner 12 to hold the vacuum cleaner on the bracket 14. The bracket mounting rim has a terminal edge 82 that is spaced from the wall when the bracket 14 is connected to the wall. The vacuum mounting rim 44 and the bracket mounting rim must be sized and configured so that, when the bracket is fixed to a wall, at least a portion of the terminal edge 50 of the vacuum mounting rim fits between the bracket mounting rim 72 and the wall. This will be discussed in a later section.

The illustrated bracket mounting rim 72 is formed in the center rail 79 of the base 70. It is arranged linearly and horizontally, and is between ⅛ inch and ¾ inches thick, between ¼ inch and six inches wide, and between ¼ inch and six inches tall. When the bracket 14 is mounted on a wall, the bracket mounting rim is positioned between ¼ inch and six inches from the wall. The lateral ends of the illustrated bracket mounting rim are reinforced by vertical reinforcing ribs 85 that extend from the bracket mounting rim toward the wall.

The Deflectable Locking Edge

The deflectable locking edge 75 locks the vacuum cleaner 12 onto the bracket 14 by blocking the vacuum cleaner from being moved off the bracket. To perform this function, the locking edge must be capable of moving from a rest position (seen in FIG. 2) to a deflected position (seen in FIG. 3).

The locking edge 75 performs its blocking function when it is in the rest position. In the illustrated combination, this rest position is a relatively short distance above the terminal edge 82 of the bracket mounting rim 72. The specific location of the locking edge with respect to the terminal edge of the bracket mounting rim depends upon the spacing of components on the vacuum cleaner 12, and will be discussed in more detail in a later section. In this combination 10, that spacing places the locking edge between ⅛ of an inch and 1 inch above the upward facing side 35' of the movable arm 20.

Although many arrangements are possible, the illustrated locking edge 75 is on the lower end of vertical release panel 85 that projects from a base portion 87 on the upper rail 79 of the illustrated mounting bracket 14. In this example, the locking edge is located between one and four inches below the base position, and between ½ inch and 4 inches from the plane of the wall. The spacing should take into account structural resistance of the locking edge to rotation about the base position. Preferably, the locking edge is positioned so that a user pressing on the release panel can readily deflect the locking edge rearwards to the required deflected position.

In the illustrated example, the required deflectability of the locking edge 75 is provided by the inherent flexibility of the plastic that connects the locking edge to the base portion 87. Alternatively, the locking edge could be connected to the base 70 through a mechanical hinge.

The deflected position of the locking edge 75 (FIG. 3) must be sufficiently inward and/or above the rest position to enable a user to rotate the movable arm 20 from the retracted position (FIG. 2) to the extended position (FIG. 4) while the vacuum cleaner 12 is positioned on the bracket 14. In the illustrated combination, the deflected position is ½ inch to three inches rearward of the rest position. The specific requirements for the deflected position will be apparent when the process of mounting of the vacuum cleaner upon the bracket is discussed in the next section.

In the illustrated combination 10, the deflected position may be slightly lower than the rest position, and the locking edge 75 is positioned high enough to enable it to clear the vacuum cleaner 10 as locking edge is deflected rearwards. Moving the base portion 87 forward could cause the locking edge to deflect rearwards and upwards, which may reduce the amount of deflection required to enable a user to rotate the movable arm 20 to the extended position. It may also increase the amount of force required, however.

It is preferred, though perhaps not always necessary, for the locking edge 75 to be biased so that it tends to automatically return to the rest position when it is free from contact with the movable arm 20 or other forces. In the illustrated combination 10, the locking edge is biased to the rest position by the resiliency of the plastic. Alternatively, it could be biased to the rest position by gravity or by mechanical means, such as a spring.

Relationship Between the Vacuum Cleaner and the Bracket

The relationship between the vacuum cleaner 12 and the bracket 14 will be discussed by first explaining how the vacuum cleaner is positioned onto the bracket, and then how the locking edge 75 locks the vacuum cleaner in place.

Positioning the Vacuum Cleaner on the Bracket

The illustrated vacuum cleaner 12 is positioned on the bracket 14 by lowering the vacuum cleaner so that the vacuum mounting rim 44 slides behind the bracket mounting rim 72 until the terminal edge 82 of the bracket mounting rim 72 hits the support surface 65 on the vacuum cleaner 12. The illustrated vacuum cleaner can be lowered into positioned onto the bracket with the movable arm 20 in either the retracted position or the extended position.

If the illustrated vacuum cleaner 12 is lowered onto the bracket 14 while the movable arm 20 is in the retracted position, the movable arm will hit the locking edge 75 or some other part of the release panel 75 as the vacuum cleaner is positioned. (As will be apparent from the discussion below, the locking edge should be arranged so that its resting position will interfere with this movement.) However, the user need only to apply some force to deflect the locking edge to the deflected position, which will then enable the vacuum cleaner to be lowered into its final resting position on the bracket. Once the vacuum cleaner is in place on the bracket, the locking edge either moves or is moved back to its rest position.

If the illustrated vacuum cleaner 12 is lowered onto the bracket 14 while the movable arm 20 is in the extended position, the locking edge 75 on the illustrated bracket can pass through the open side of the recess 25 and thus can remain in the rest position throughout the positioning of the vacuum cleaner. The illustrated recess 25 has relatively high lateral sidewalls 90, and the required movement of the vacuum cleaner is enabled by providing that the locking edge is laterally narrower than the corresponding spacing between the sidewalls.

If the vacuum cleaner 12 is positioned on the bracket 14 while the movable arm 20 is in the extended position, then the movable arm should be moved to the retracted position after the vacuum cleaner is in position. The locking edge 75 should interfere with this movement, but the interference again can be overcome by the user applying force to deflect the locking edge to the deflected position.

When the vacuum cleaner 12 is positioned on the bracket 14, the support surface 65 on the illustrated vacuum cleaner rests on the upward-facing terminal edge 82 of the bracket mounting rim 72, with the bracket mounting rim preventing the vacuum mounting rim 44 from sliding outwardly. Side-to-side movement of the vacuum cleaner with respect to the bracket is limited by the reinforcing ribs 85 on the mounting bracket, which fit into the grooves 55 in the illustrated vacuum mounting rim. Alternatively, a comparable rib or side walls could be provided on the vacuum cleaner, and engage a comparable groove or end wall on bracket mounting rim. Many other configurations can be used, provided that the other components of the combination 10 are set accordingly. For example, a concave bracket mounting rim could be used with a convex vacuum mounting rim. And, rather than having the upward-facing terminal edge of bracket mounting rim engage a downward-facing support surface on the vacuum cleaner, the downward-facing terminal edge on the vacuum cleaner could be arranged to engage an upward-facing support surface on the bracket.

Locking the Vacuum Cleaner in Place

Once the vacuum cleaner 12 is in position on the bracket 14 and the locking edge 75 returns to or is returned to its rest position, the locking edge blocks reversal of the movement that was used to position the vacuum cleaner on the bracket 14; i.e., it blocks both removal of the vacuum cleaner from the bracket and movement of the movable arm 20 to the extended position.

In the illustrated example, this blocking is achieved by positioning the locking edge 75 so that the distance from its rest position to the corresponding part of the vacuum cleaner 12 is less than the distance that the vacuum cleaner has to be raised for the two mounting rims 44, 72 to clear each other and allow the vacuum cleaner to move forward off the bracket 14. Generally, this spacing can be satisfied by ensuring that the vertical distance between the locking edge and the upward-facing terminal edge 82 on the bracket mounting rim 72 is less than the vertical distance from the downward-facing terminal edge 50 on the vacuum mounting rim 44 to the part of the vacuum cleaner that sits directly beneath the locking edge when the vacuum cleaner is positioned on the bracket.

When the illustrated vacuum cleaner 12 is positioned on the bracket 14 with the movable arm 20 is in the retracted position, the locking edge 75 is positioned above the upper side 35' of that arm. Thus, the distance between the terminal edge 50 of the vacuum mounting rim 44 and the base surface 37 plus the corresponding distance between the two sides 35, 35' of the movable arm (i.e., the distance from the base surface to the point on the movable arm beneath the locking edge) exceeds the distance between the locking edge and the terminal edge 82 on the bracket mounting rim 72.

The vacuum cleaner 12 can be removed from the bracket 14 by first moving the locking edge 75 to the deflected position, and then rotating the movable arm 20 to the extended position. A user can readily deflect the illustrated locking edge to the deflected position by pressing on the release panel 85, which is exposed above the top of the mounted vacuum cleaner 12. The movable arm 20 can then be rotated from the retracted position into the extended position, moving the arm out of the recess 25. The recess is partially open on the side of the vacuum cleaner that supports the vacuum mounting rim 44. When the movable arm is retracted, this opening provides more open space under the locking edge 75 and permits the vacuum cleaner to be lifted far enough up off the bracket to permit the two mounting rims 44, 72 to clear each other.

The space required for this movement is created by positioning the base surface 37 of the vacuum cleaner 12 (i.e., the surface that the movable arm 20 rests on and that is opened up when the arm is extended) relatively close to the terminal edge 50 of the vacuum mounting rim 44. In the illustrated combination, the base surface 37 is set at a distance from the terminal edge of the vacuum mounting rim that is less than the distance between the terminal edge 82 of the bracket mounting rim 72 and the locking edge 75. This spacing enables the vacuum cleaner 12 to be positioned on the bracket 14 and removed from it without interference from the locking edge, so long as the movable arm is extended out of the recess.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A wall-mountable vacuum cleaner and bracket combination that has:

a wall-mountable bracket;

a vacuum cleaner that a user can position on the bracket when it is mounted on a wall; and a movable arm on the vacuum cleaner that a user can move to a retracted position in which the movable arm secures the vacuum cleaner on the bracket.

2. A wall-mountable vacuum cleaner and bracket combination as recited in claim 1, in which:

the bracket has a bracket mounting rim that has a terminal edge that is spaced from the wall when the bracket is connected to the wall; and the vacuum cleaner has a vacuum mounting rim that has a terminal edge that fits between the bracket mounting rim and the wall when the bracket is connected to a wall and the vacuum cleaner is mounted on the bracket.

3. A wall-mountable vacuum cleaner and bracket combination as recited in claim 1, in which:

the bracket has a bracket mounting rim that has a terminal edge that is spaced from the wall when the bracket is connected to the wall;

the vacuum cleaner has a vacuum mounting rim that has a terminal edge that fits between the bracket mounting rim and the wall when the bracket is connected to a wall and the vacuum cleaner is mounted on the bracket; and a support surface is connected to a proximal end of one of the two mounting rims and engages the terminal edge of the other of the two mounting rims when the vacuum cleaner is mounted on the bracket.

4. A wall-mountable vacuum cleaner and bracket combination as recited in claim 1, in which:

the bracket has a deflectable locking edge that moves between (a) a rest position in which, when the bracket is mounted to a wall and the movable arm on the vacuum cleaner is in an extended position, the vacuum cleaner can be lowered onto the bracket, and (b) a deflected position in which the movable arm can be moved between the extended position and the retracted position while the vacuum cleaner is mounted on the bracket.

5. A wall-mountable vacuum cleaner and bracket combination that has:

a wall-mountable bracket that has (a) a base that can be connected to a wall and (b) a bracket mounting rim that has a terminal edge that is spaced from the wall when the bracket is connected to the wall;

a vacuum cleaner that a user can mount on the bracket when the bracket is connected to a wall;

a movable arm on the vacuum cleaner that a user can move between (a) an extended position in which a handgrip is accessible above an upper surface of the vacuum cleaner; and (a) a retracted position in which the movable arm lies with (a) one side on a base surface within a recess in the upper surface, and (b) an opposed side spaced away from the base surface; and a vacuum mounting rim that is on the vacuum cleaner and has a terminal edge that fits between the bracket mounting rim and the wall when the bracket is connected to a wall and the vacuum cleaner is mounted on the bracket;

a support surface that is connected to a proximal end of one of the two mounting rims and engages the terminal edge of the other of the two mounting rims when the vacuum cleaner is mounted on the bracket;

a deflectable locking edge that is on the bracket, is narrower than the recess on the vacuum cleaner, and moves between (a) a rest position in which, when the bracket is mounted to a wall, the vacuum mounting rim can be lowered into a position between the bracket mounting rim and the wall, and b) a deflected position in which the movable arm can be moved between the extended position and the retracted position while the vacuum cleaner is mounted on the bracket.

6. A wall-mountable vacuum cleaner and bracket combination that has:

a wall-mountable bracket that has a base that can be connected to a wall;

a bracket mounting rim that is on the bracket and has a terminal edge that is spaced from the wall when the bracket is connected to the wall;

a vacuum cleaner that a user can store on the bracket when the bracket is connected to a wall;

a movable arm on the vacuum cleaner that a user can move between (a) a retracted position in which the movable arm lies with one side on a base surface and an opposed side spaced away from the base surface; and (b) an extended position in which the movable arm is spaced from the base surface;

a vacuum mounting rim that is on the vacuum cleaner and has a terminal edge that fits between the bracket mounting rim and the wall when the bracket is connected to a wall and the vacuum cleaner is stored on the bracket;

a support surface that is connected to a proximal end of one of the two mounting rims and engages the terminal edge of the other of the two mounting rims when the vacuum cleaner is stored on the bracket;

a deflectable locking edge that is on the bracket and moves between (a) a rest position in which both (i) the distance between the terminal edge of the bracket mounting rim and the locking edge exceeds the distance between the terminal edge of the vacuum mounting rim and the base surface, enabling the vacuum cleaner to be positioned onto the bracket without interference from the locking edge when the movable arm is extended, and (ii) the distance between the terminal edge of the vacuum mounting rim and the base surface plus the corresponding distance between the two sides of the movable arm exceeds the distance between the terminal edge of the bracket mounting rim and the locking edge on the locking edge, causing one or both of the terminal edges to block removal of the vacuum cleaner from the bracket when the movable arm is in the retracted position, and b) a deflected position in which the movable arm can be moved between the extended position and the retracted position while the vacuum cleaner is stored on the bracket.

* * * * *